US008065962B2

(12) United States Patent
Haeselich

(10) Patent No.: US 8,065,962 B2
(45) Date of Patent: Nov. 29, 2011

(54) PROJECTILE THAT MARKS THE STRIKE POINT

(75) Inventor: Detlef Haeselich, Muessen (DE)

(73) Assignee: Rheinmetall Waffe Munition GmbH, Trittau (DE)

( * ) Notice: Subject to any disclaimer, the term of this patent is extended or adjusted under 35 U.S.C. 154(b) by 2094 days.

(21) Appl. No.: 10/897,931

(22) Filed: Jul. 23, 2004

(65) Prior Publication Data

US 2008/0053330 A1 Mar. 6, 2008

(30) Foreign Application Priority Data

Apr. 8, 2004 (DE) ..... 10 2004 017 466

(51) Int. Cl.
*F42B 12/40* (2006.01)

(52) U.S. Cl. ..... 102/513; 102/529; 102/498

(58) Field of Classification Search ..... 102/513, 102/444, 439, 529, 498
See application file for complete search history.

(56) References Cited

U.S. PATENT DOCUMENTS

| | | | | |
|---|---|---|---|---|
| 4,128,059 | A * | 12/1978 | Black | 102/513 |
| 4,281,599 | A * | 8/1981 | Weber et al. | 102/364 |
| 5,565,649 | A * | 10/1996 | Tougeron et al. | 102/502 |
| 5,654,524 | A * | 8/1997 | Saxby | 102/513 |
| 6,497,181 | B1 * | 12/2002 | Manole et al. | 102/513 |
| 6,619,211 | B1 * | 9/2003 | Haeselich | 102/513 |
| 6,931,993 | B1 * | 8/2005 | Manole et al. | 102/458 |
| 7,278,358 | B2 * | 10/2007 | Huffman | 102/502 |
| RE40,482 | E * | 9/2008 | Haeselich | 102/513 |
| 7,475,638 | B2 * | 1/2009 | Haeselich | 102/513 |
| 7,487,728 | B2 * | 2/2009 | Cranor | 102/513 |
| 7,819,065 | B2 * | 10/2010 | Haeselich | 102/444 |

FOREIGN PATENT DOCUMENTS

EP 1183494 B1 2/2003

* cited by examiner

*Primary Examiner* — James Bergin

(74) *Attorney, Agent, or Firm* — Karl F. Milde, Jr.; Eckert Seamans Cherin & Mellott, LLC

(57) ABSTRACT

A projectile, particularly a practice round, has a projectile body that includes a hollow ogive that bursts upon striking the target into which marking material is inserted. The marking material is released when the projectile strikes the target and the ogive bursts. The marking material is covered by a protective cap that breaks when the projectile bursts on the target.

12 Claims, 2 Drawing Sheets

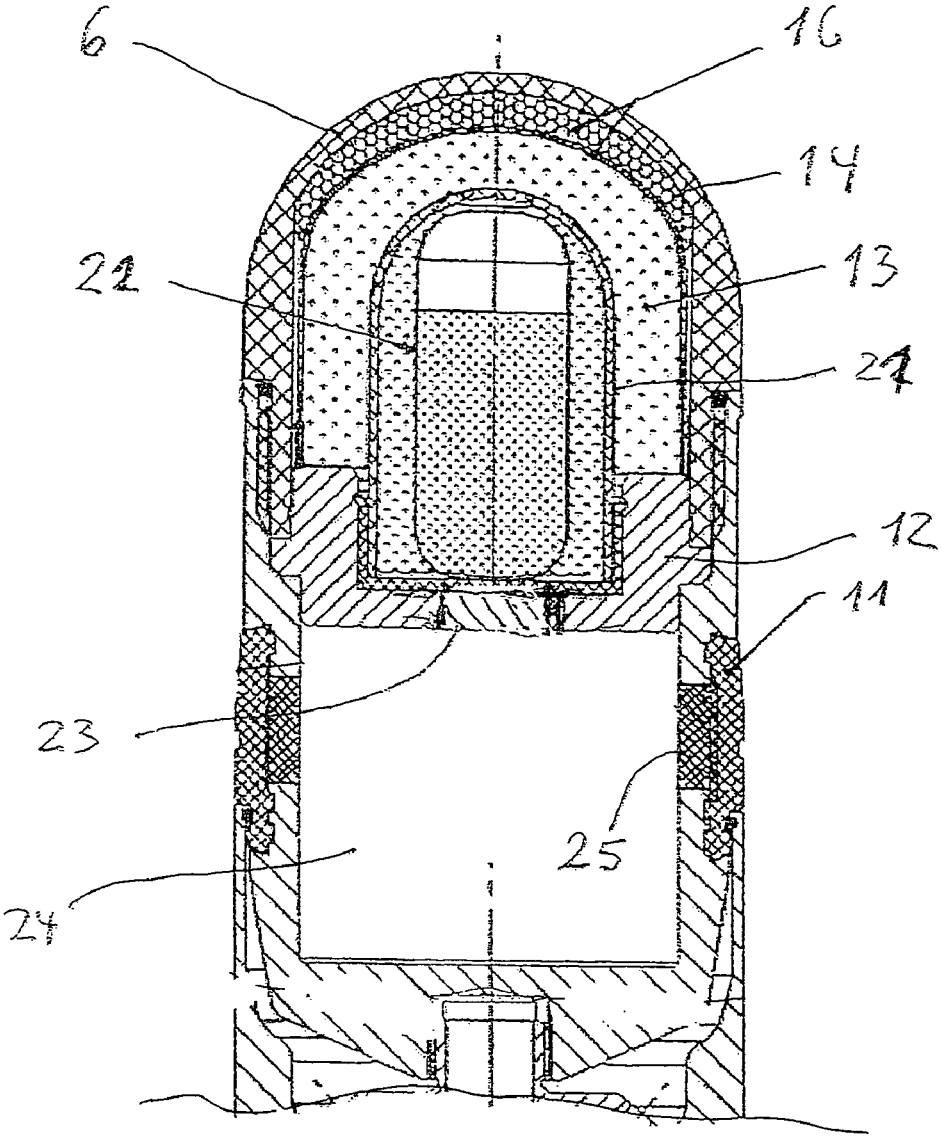
Fig. 3.
Fig. 2
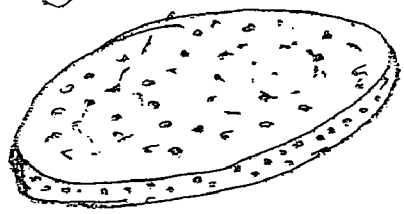

PROJECTILE THAT MARKS THE STRIKE POINT

BACKGROUND OF THE INVENTION

The invention relates to a projectile, particularly to a practice round, with a projectile body including a hollow ogive (cup-shaped head) that bursts upon striking the target. This ogive contains dye, particularly a colored powder, whereby the marking material is released to mark the strike point when the projectile strikes the target and when the ogive bursts.

In a practice round, e.g., a practice projectile or a practice bomb that itself does not include live explosive, it is important to mark the strike point on the target so that optimal practice results may be obtained.

For this, the projectile includes at its tip an ogive into which the marking material, e.g., a reddish dye powder, is inserted. The ogive is made of a material such as plastic that bursts when it strikes the target, releasing the dye powder. The dye is scattered for a certain radius around the strike point, and is also scattered by the wind, thus showing the strike point clearly.

Projectiles of the type discussed here are, for example, mid-caliber projectiles (40 mm) that are belt-fed and that are fired from a rapid-fire cannon in series.

When handling such projectiles, the ogive of a projectile in the belt occasionally breaks open when it strikes an object, at least partially releasing the marking material and contaminating other projectiles. When this occurs the affected projectiles in the belt must be replaced. It is even worse if, for example, the projectile is improperly aligned in the rapid-fire cannon. In such case, the ogive of the projectile may be broken within the chamber, leading to contamination of the weapon, which must subsequently be cleaned, resulting in lost time. Also, such a misalignment of a live round fired from that weapon may lead to a loading jam.

SUMMARY OF THE INVENTION

It is the object of the invention to prevent the ogive from breaking and the releasing the marking material.

A further object is to prevent weapon contamination if the ogive bursts within the firing chamber.

In accordance with the invention, a projectile of the above-mentioned type is provided, within whose ogive a marking material is inserted, whereby the marking material is protected by a protective cap that bursts when the projectile strikes the target.

The marking material is also adequately protected by the protective cap if the ogive is broken by improper handling so that no marking material is released.

Protection may be increased if an intermediary space is left between the inner walls of the ogive of the protective cap near the projectile tip.

Such an intermediary space is preferably provided with filler material, which may be, for example, a soft foam resting on the inner wall of the ogive and the outer wall of the protective cap. The filler material essentially serves to catch any splinters when the ogive bursts that otherwise may have harmed the protective cap.

If, for example, the ogive is damaged within the firing chamber of a rapid-fire cannon because of misalignment, the weapon is not contaminated by escaping marking material, and any splinters are trapped, and it is even possible that the projectile will be fired successfully.

In the previous text, only a red powder has been mentioned as a marking material. It is advantageous in many cases to include a material visible at night such as a chemoluminescent material located within a container possessing several compartments. When the projectile strikes the target, the container with its compartments containing the chemoluminescent material breaks, mixing the chemoluminiscent components so that an illumination effect is produced. Use of such a combination makes the target strike point visible both day and night.

The container with its compartments for chemoluminescent material may, as described in the European Patent Publication No. EP-B1-1 183 494, otherwise be broken by the initial acceleration and/or, with the use of properly designed twist-stabilized projectiles, by centrifugal force, so that the trajectory of the projectile may be tracked optically while in flight. Since in this case the dye powder is inserted between the outside of the ogive and the container receiving the chemoluminescent material, suitable passages must be provided within the projectile so that the light created by the chemoluminescent material may be released. For this, for example, several regions of the projectile body (the so-called twist-band) may be of transparent material whereby the light created by the chemoluminescent material flows into a hollow cavity in the area of the twist-band. Suitable light conductors of transparent plastic are also possible here, whereby these conductors or other passages may be routed through the dye powder to suitable transparent regions of the projectile body or to the ogive.

For a full understanding of the present invention, reference should now be made to the following detailed description of the preferred embodiments of the invention as illustrated in the accompanying drawings.

BRIEF DESCRIPTION OF THE DRAWINGS

FIG. 2 is a plate of soft foam inserted between the protective cap and the ogive within the projectile per FIG. 1.

FIG. 3 is a cross-section through a second embodiment of a projectile with a combined marking material by means of which the strike point of the projectile on the target is visible day or night.

DESCRIPTION OF THE PREFERRED EMBODIMENTS

Figure 1A:
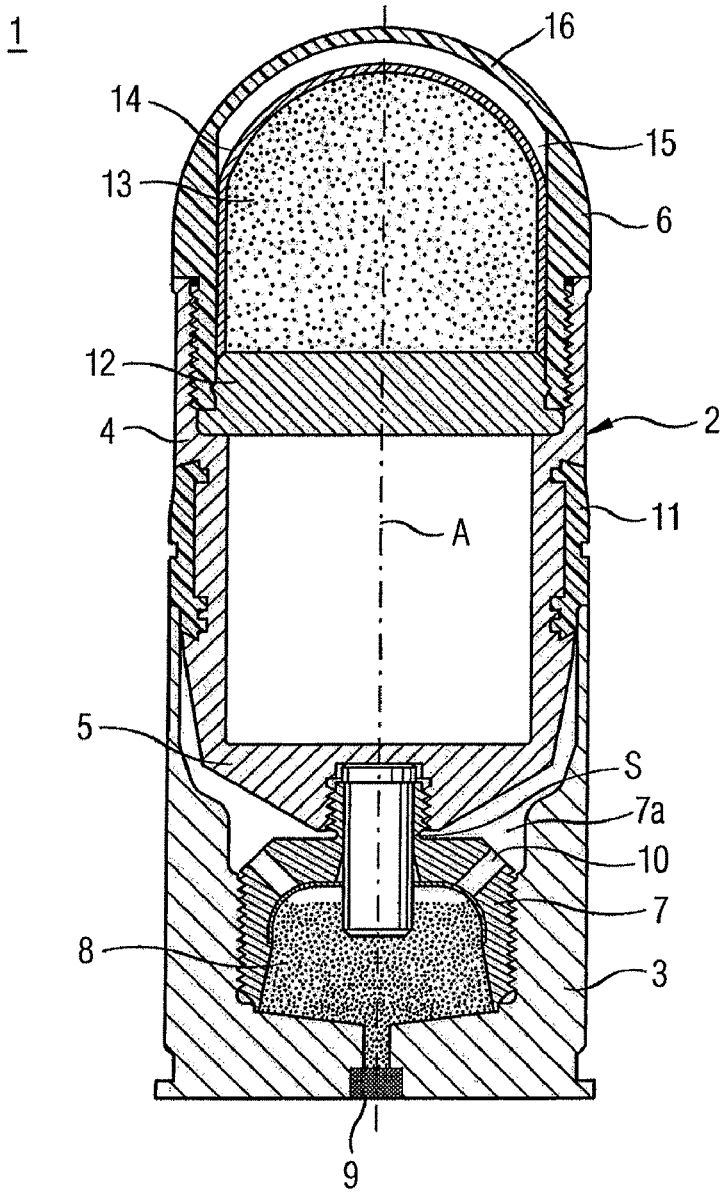
FIG. 1A is a cross-section through a cartridge munition consisting of a cartridge shell and a practice round that contains a marking material within the ogive covered by a protective cap.

The preferred embodiments of the present invention will now be described with reference to FIGS. 1-3 of the drawings. Identical elements in the various figures are designated with the same reference numerals.

FIG. 1 shows a cross-section of a practice round 1 that includes a projectile 2 mounted in a cartridge shell. The projectile 2 includes a projectile body 4 with a projectile base 5 facing the cartridge shell 3 and a front ogive 6. Within the cartridge shell 3 a high-pressure propulsion chamber is positioned in which a propulsive charge 8 is provided that combusts upon ignition of an igniter 9. The propulsive gases from the propulsive charge flow via overflow channels 10 into a low-pressure propulsion chamber 7*a*, where they act on the projectile base. When a certain gas pressure is exceeded within the propulsion chamber, an intentional-break point S between the cartridge shell and the projectile is broken, so that the projectile 2 is propelled out of the cartridge shell 3.

The illustrated practice round is usually fired from a weapon with a drawn barrel with a twist, so an additional twist- or guide-band 11 is provided on the projectile body 4.

Such a practice round consisting of cartridge shell and projectile is described, for example, in U.S. Pat. No. 5,936,189.

Figure 1B:
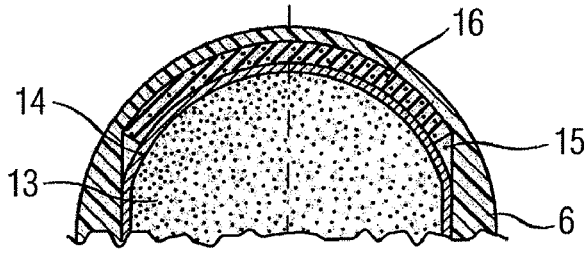
FIG. 1B is cross-section through the tip portion of the projectile of FIG. 1A, showing the addition of filler material inserted in an intermediary space between the protective cap and the ogive.

The ogive 6 rests on an insert 12 within the projectile body that extends perpendicular to the longitudinal axis A of the projectile body 4. The ogive 6 is, for example, a plastic part, cylindrical in its lower region, which transforms into a vaulted hood with the shape of a universal ball joint. In the hollow inner portion of the ogive 6 a marking material, in this case a red dye powder 13, is provided that is placed into a protective cap 14 that covers it. The protective cap 14 that is made, for example, of polyethylene terephthalate (PET), is completely filled with dye, and has a shape roughly corresponding to that of the ogive 6; that is, it has a lower cylindrical part that rests closely on the inner wall of the cylindrical part of the ogive 6 and an adjacent vaulted hood that extends approximately parallel to the hood of the ogive. A small intermediate space 15 is provided between the protective cap 14 and the ogive 6 as shown in FIG. 1A. The space 15 is preferably filled with a filler material 16 that rests on the protective cap 14 and the inner wall of the ogive 15 in the vaulted portion as shown in FIG. 1B. This material 16 may be, for example, a plate of soft foamed material, as shown in FIG. 2. When the projectile is manufactured, this foam plate 16 is inserted into the vaulted part of the ogive 6, and then the protective cap 14 filled with dye material 13 and the insert 12 is inserted into the ogive.

As mentioned above, when the vaulted part of the ogive 6 of the projectile 2 is damaged, e.g., by improper handling of the cartridge or by a misalignment with the firing chamber of the weapon being fired, then the space between the ogive and the protective cap ensures that the protective cap remains intact, thus allowing no dye to escape. The foam basically has the function of protecting the protective cap 14 from damage by any splinters from the damaged ogive.

FIG. 3 shows a cross-section through a projectile 2 with a projectile body 4 and an ogive 6 whereby a dye powder is placed into a protective cap 14 within the ogive 6. As in the projectile in FIG. 1, there is a space 15 left between the protective cap 14 and the ogive into which a plate 16 of soft plastic is inserted.

A container 21 within which an inner container 22 is mounted rests on the insert 12 that forms the base of the ogive 6. A material is inserted into the inner container 22 and into the space between the inner container and the container 21 that reacts with chemoluminescence upon mixing with the other material. As soon as the projectile strikes a target, the ogive 6 bursts and the dye powder 13 is released. Simultaneously, the containers 21 and 22 are broken so that the two chemoluminescent materials react with each other, releasing an illuminating signal within the normal visible spectrum, or perhaps within the infrared region that is visible over long distances.

As described in the above-mentioned U.S. Pat. No. 5,936,189, the two containers 21 and 22 may be so configured that they burst immediately upon initial acceleration of the projectile and/or by the twisting motion of the projectile immediately after firing, so that the chemoluminescent reaction is initiated. When the light thus created is conducted outward from the projectile body, the trajectory of the projectile may be followed.

There is the option to configure the base of the insert 12 to be transparent at least in a partial region 23 below the two containers 21 and 22 so that the light created by chemoluminescence shines, for example, into a hollow cavity 24 of the projectile body. When one configures the guide- or twist-band 11 to be translucent and the wall of the hollow cavity 24 in a region 25 of the guide-band, then the light may exit from the hollow cavity 24 to the outside, so that the trajectory of the projectile may be followed.

It is possible, of course, to find other passages to the outside for light created by chemoluminescence. For example, the insert 12 itself might be transparent and extend to translucent regions in the wall of the projectile body so that light is also perceptible from the outside.

There has thus been shown and described a novel projectile that marks the strike point which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Projectile, particularly a practice round, with a projectile body that includes a hollow ogive with a vaulted hood forming a projectile tip that bursts upon striking the target and marking material contained in the ogive which is released when the projectile strikes the target and the ogive bursts, the improvement wherein the marking material is covered by a protective cap that breaks when the projectile bursts on the target, said protective cap having a vaulted hood that extends substantially parallel to the hood of the ogive.

2. Projectile as in claim 1, wherein an intermediary space is left between the vaulted hood of the ogive and that of the protective cap in the area of the projectile tip.

3. Projectile as in claim 1, wherein the marking material comprises chemoluminescent material consisting of several components.

4. Projectile as in claim 3, further comprising a container for the chemoluminescent material which bursts when the projectile strikes the target, whereby the components are mixed and emission of light is triggered.

5. Projectile as in claim 4, wherein the container possesses two compartments in which the components of the chemoluminescent material are located.

6. Projectile as in claim 4, wherein the container for the chemoluminescent material breaks open from at least one of the twist and the initial acceleration of the projectile so that the components of the chemoluminescent material mix together and chemoluminescence is generated, and wherein light paths are provided within the projectile in order to conduct the light created by chemoluminescence outward from the projectile body.

7. Projectile as in claim 3, wherein the marking material further comprises a dye powder.

8. Projectile as in claim 1, wherein the marking material comprises a dye powder.

9. Projectile, particularly a practice round, with a projectile body that includes a hollow ogive with a vaulted hood forming a projectile tip that bursts upon striking the target and marking material contained in the ogive which is released when the projectile strikes the target and the ogive bursts, the improvement wherein the marking material is covered by a protective cap that breaks when the projectile bursts on the target, said protective cap having a vaulted hood that extends substantially parallel to the hood of the ogive, and wherein filler material is positioned in the intermediary space that rests on the ogive and the protective cap.

10. Projectile as in claim 9, wherein the filler material is soft foam.

11. Projectile as in claim 9, wherein the filler material is a plate-shaped piece that is inserted into the intermediary space between protective cap and ogive.

12. Projectile as in claim 9, wherein the marking material comprises a dye powder.

* * * * *